United States Patent [19]

Mock

[11] 4,274,903

[45] Jun. 23, 1981

[54] HIGH SPEED PROGRAMMABLE PRESSURE-SENSITIVE TRANSFER TAPE APPLICATOR

[76] Inventor: Vernon A. Mock, 2250 Linneman, Glenview, Ill. 60025

[21] Appl. No.: 57,209

[22] Filed: Jul. 13, 1979

[51] Int. Cl.[3] ..... B26D 5/00

[52] U.S. Cl. ..... 156/355; 156/522

[58] Field of Search ..... 156/522, 353–355, 156/518, 530; 242/75.44

[56] References Cited

U.S. PATENT DOCUMENTS

| | | | |
|---|---|---|---|
| 3,066,723 | 12/1962 | Remington et al. | 156/522 |
| 3,406,084 | 10/1968 | Varga | 156/522 |
| 3,822,838 | 7/1974 | Butler | 242/75.44 |
| 3,886,033 | 5/1975 | McDonald et al. | 156/522 |
| 3,892,618 | 7/1975 | Griebat | 156/522 X |
| 3,901,757 | 8/1975 | Eglinton | 156/522 X |
| 3,992,240 | 11/1976 | Kuehn | 156/522 X |
| 4,004,962 | 1/1977 | Kleid | 156/522 X |
| 4,030,958 | 6/1977 | Stenemann | 156/522 X |

*Primary Examiner*—David A. Simmons

[57] ABSTRACT

A programmable apparatus for applying pressure-sensitive transfer tape in selective lengths to sheet material at high speed, which is adaptable for other sheet preparation purposes.

10 Claims, 13 Drawing Figures

60
61
62
63
22
16
36
108
110
112
109
114
38
111
113
64
119
118
117
116

28
29
31
61
12
40
42
35
44
43

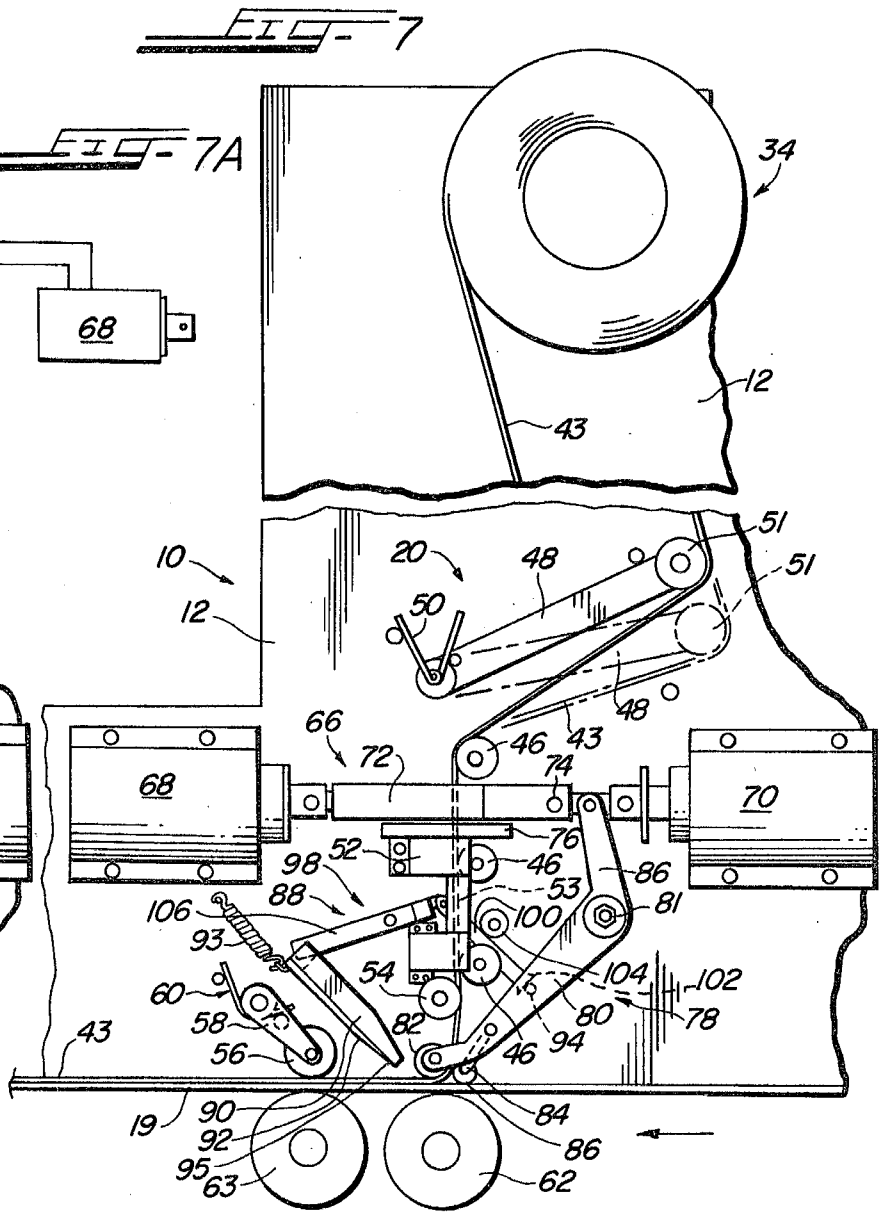
FIG-7
FIG-7A
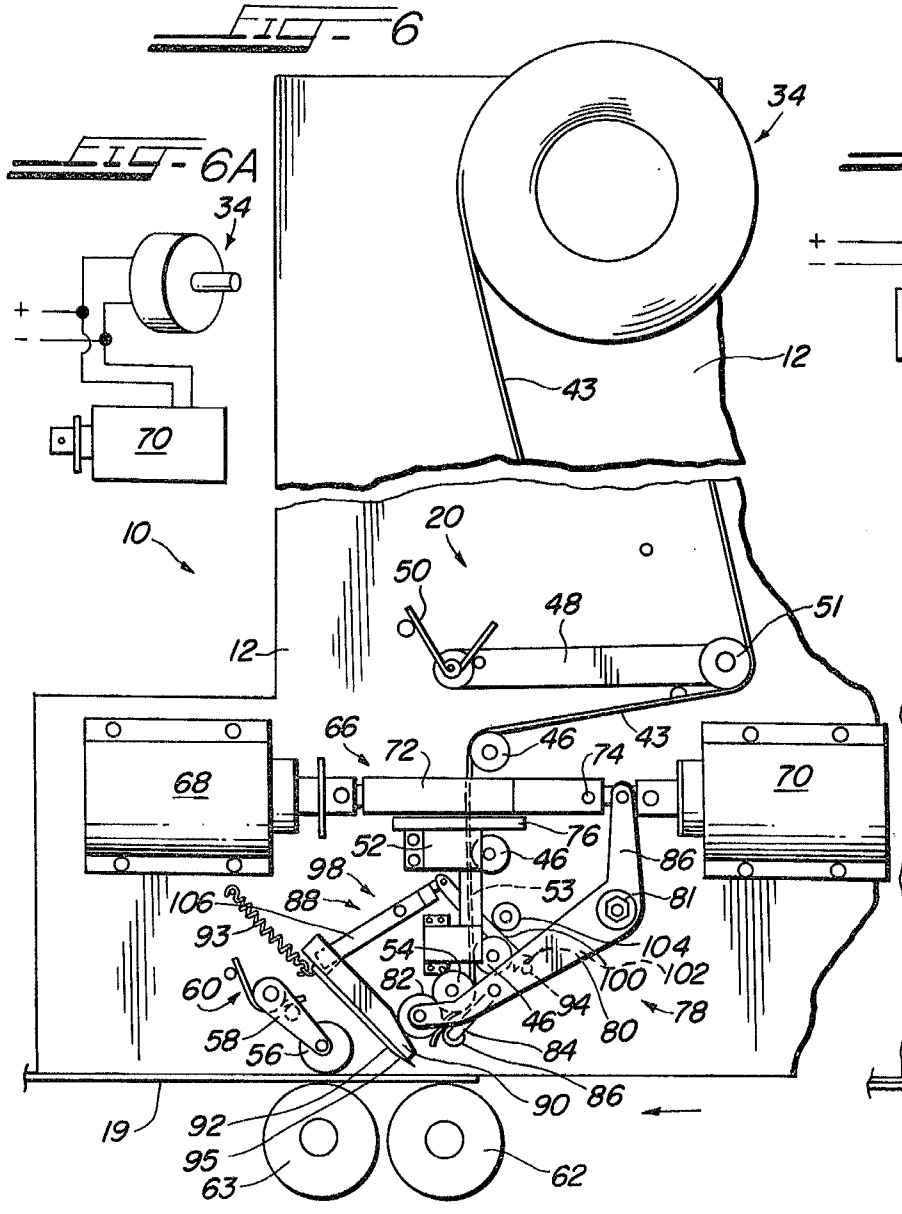
FIG-6
FIG-6A

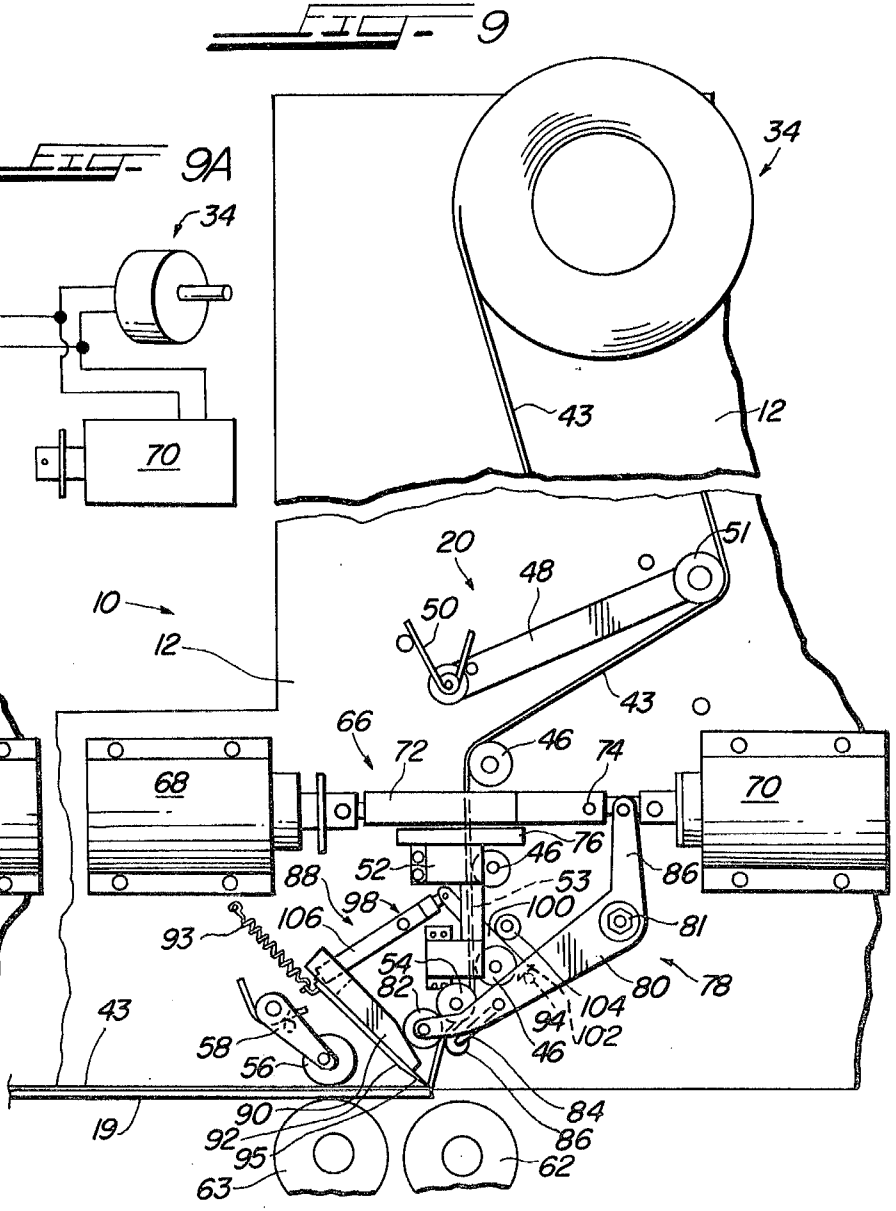
FIG-9
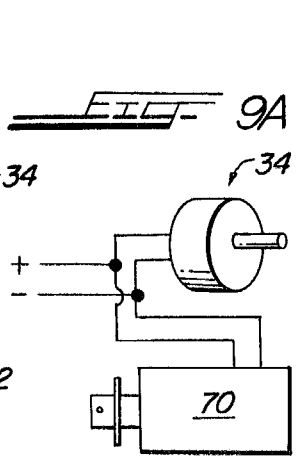
FIG-9A
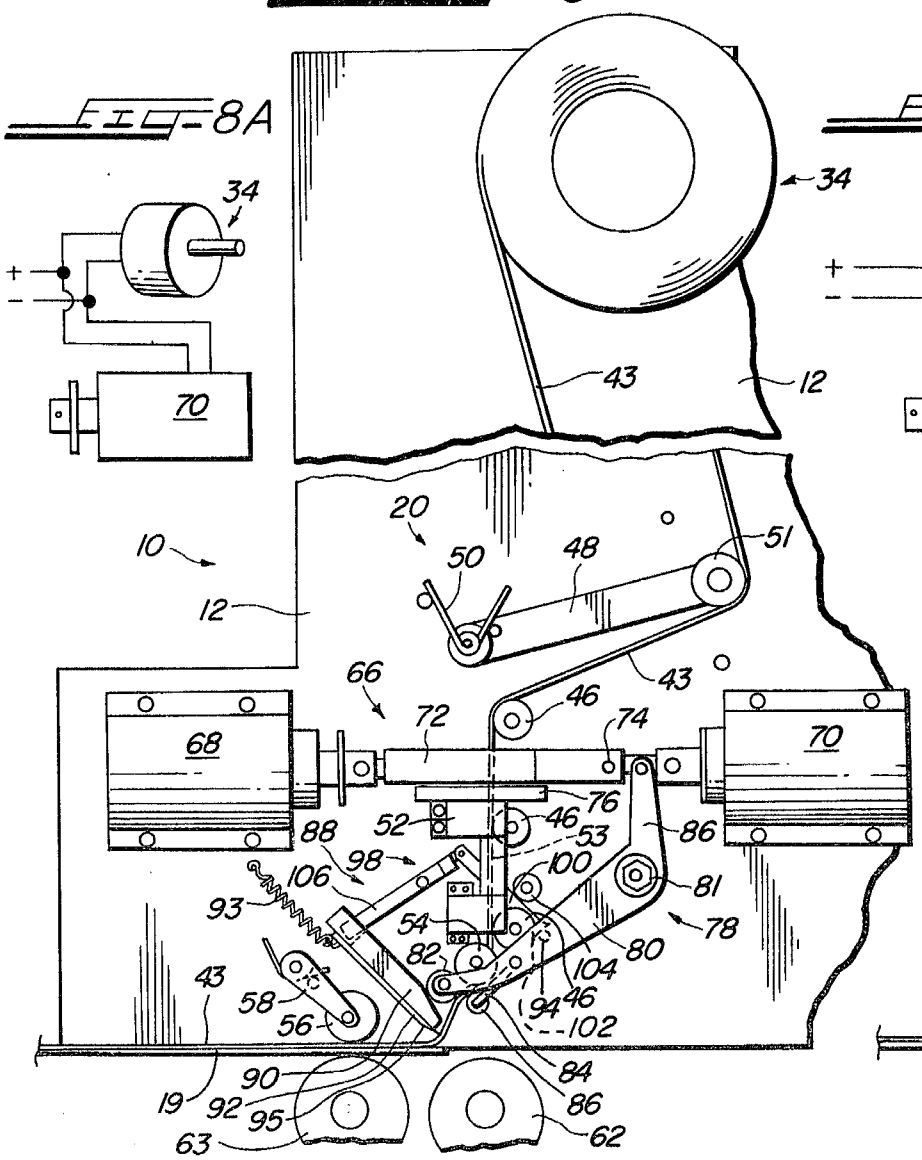
FIG-8
FIG-8A

HIGH SPEED PROGRAMMABLE PRESSURE-SENSITIVE TRANSFER TAPE APPLICATOR

BACKGROUND OF THE INVENTION

In recent years, advertising and other forms of printed literature in sheet form have been distributed to the ultimate user with adhesive applied to the margins thereof in the form of strips of adhesive transfer tapes each comprising a backing strip having a loosely held layer of adhesive material on the side thereof which is face down upon the sheet material and a non-tacky outer face which permits stacking of similar sheets without the sticking together of adjacent sheets in the stack. When the ultimate user desires to apply the sheet material to a vertical wall surface, he peels the backing strip from the sheet material, leaving the adhesive layer upon the sheet material. The sheet material may then be adhesively secured to a vertical wall surface by applying the adhesive-coated side of the sheet material against the wall surface involved.

The machinery heretofore used to apply the adhesive transfer tape at high speeds to the sheet material was single-purpose and very costly and only a relatively few sheet processing plants were available for applying the adhesive transfer tape to sheet material. Other machines were needed to perforate stock, to blade-slit stock, to crease and score stock, and to rotary-slit stock. The sheet material involved was first processed by the printer who provided individual printed sheets in the usual manner. Then, the sheets were usually delivered to the nearest plant having the above mentioned tape-applying machinery, which plant, in many cases, was located hundreds of miles away from the printing plant and from the distributor of the printed material. This procedure was costly in both time and money.

It is apparent that the spacing of the areas of transfer tape applied to the sheets of material fed through the machine varies with the size of the sheet material involved. Another variable with which the machine must deal is the form or pattern of the areas of adhesive transfer tape applied to the sheet material. For example, the tape can be applied in long strips or in spots. In the latter case, the size and spacing of the spots can vary. The tape-applying machines heretofore made are not readily adaptable to these varying conditions. Moreover, difficulty is encountered in operating the machines at high speeds, particularly where the sheet material is thin and fragile, and for any relative movement between the tape and the sheet material in the process of applying such tape will tear the sheet material.

It is, accordingly, an object of the present invention to provide a machine which can be readily adapted to programmably apply pressure-sensitive transfer tape and adjusted to receive sheet material and pressure-sensitive adhesive tape of widely varying widths and lengths and to apply the tape to a number of areas of the sheet material with a variety of patterns and special arrangements in a single pass of the sheet material through the machine. A related object of the invention is to provide a tape-applying machine which can selectively apply a strip of adhesive tape extending the full length of the sheet material involved or in spots thereon. Furthermore, two or more different programs can apply spots simultaneously. Another object of the present invention is to provide a machine for applying strips of adhesive tape at high feeding rates to even thin, fragile sheet materials. It shall also be adaptable to readily accommodate heads to perforate stock, heads to blade-slit stock, heads to crease-score stock, and heads to rotary-slit stock.

SUMMARY OF THE INVENTION

The gist of this invention lies in a programmable sheet feed table which is adaptable to operationally mounting a variety of heads for preparing the same and comprises a horizontal rail which extends over the table transversely to the direction of movement of sheet material thereon. The heads are activated by optoelectronic means which sense when sheet is present on the table and electro-mechanically actuate instructions from programming means to perform specific sheet preparation functions desired. The sheet-sensing means operationally mounts on the rail support and is directed at the passage of the leading and trailing edges of the sheet for detecting the presence or absence of the same. The programming means operationally connects to the drive train of the sheet feed rollers on the table through an electro-mechanical clutch for starting and stopping the programming means. Sheet preparation instructions are stored in memory as strips of information on the surface of a drum. Information is serially retrieved from the drum by engaging the clutch and rotating the drum. Access is made to this information by optoelectronic reading. Rotation of the drum is coordinated with the position of the sheet on the table as it moves across the table by means of the sheet feed drive train.

The gist of the specific tape applicator invention lies in a static head which applies the end portion of pressure-sensitive transfer tape to the high speed moving sheet as the tape is dispensed from a tape roll. The tape roll mounts on an electro-mechanically braked reel which is brakable to the head. A roller for applying the tape to the sheet mounts on the end of an application arm which is pivoted to the head. Tape is applied to the sheet by rolling of the roller on the tape to the surface of the sheet. A driving arm extends from the pivoted portion of the application arm as a bellcrank for actuation of the tape-apply mode when the presence of sheet so activates. A double-acting pair of conical pole solenoids operationally connect each of their armatures to a respective end of a shuttle bar and to the driving arm of the bellcrank therebetween for rotation of the same in one direction in tape-apply mode and in the other direction at high speed in tape-cutoff mode.

Tape-cutoff mode mechanically actuates reciprocal movement of the knife for cutoff of the tape at high speed with respect to movement of the application arm through the link-up of an intervening link and lever mechanism so as to drive the knife down at high speed as the application roller on the arm lifts the tape up from the sheet. Momentum of the knife in its high speed downward movement as a free body during cutoff carries the knife beyond mechanical link-up of the link and lever mechanism so as to cut the tape. Simultaneously, the tape reel is instantaneously locked to the head and dispensation of tape immediately stops while the end portion of the tape which has been transferred to the sheet under tension from continued movement of the sheet and the cessation of dispensation of tape from the reel lifts off from the sheet against the knife for the cutoff. The knife, as a free body, quickly, returns to mechanical link-up with the link and lever mechanism under action of a restoring spring, after which it further retracts to its no-application mode position fully linked-up. Slack and shock is taken out of the line of the dispensed tape by a roller in a loop in the feed line of the tape on the end of a torsionally-compliant pivoted arm.

DESCRIPTION OF THE DRAWINGS

FIG. 6 is a fragmented side view of the tape applicator programmed for no-application of tape;

FIG. 6A is a schematic of the electrical circuit for FIG. 6;

FIG. 7 is a fragmented side view of the tape applicator programmed to apply tape;

FIG. 7A is a schematic of the electrical circuit for FIG. 7;

FIG. 8 is a fragmented side view of the tape applicator programmed to end application of tape;

FIG. 8A is a schematic of the electrical circuit for FIG. 8;

FIG. 9 is a fragmented side view of the tape applicator programmed to cut tape; and FIG. 9A is a schematic of the electrical circuit for FIG. 9.

DESCRIPTION OF THE PREFERRED EMBODIMENT

Figure 1:
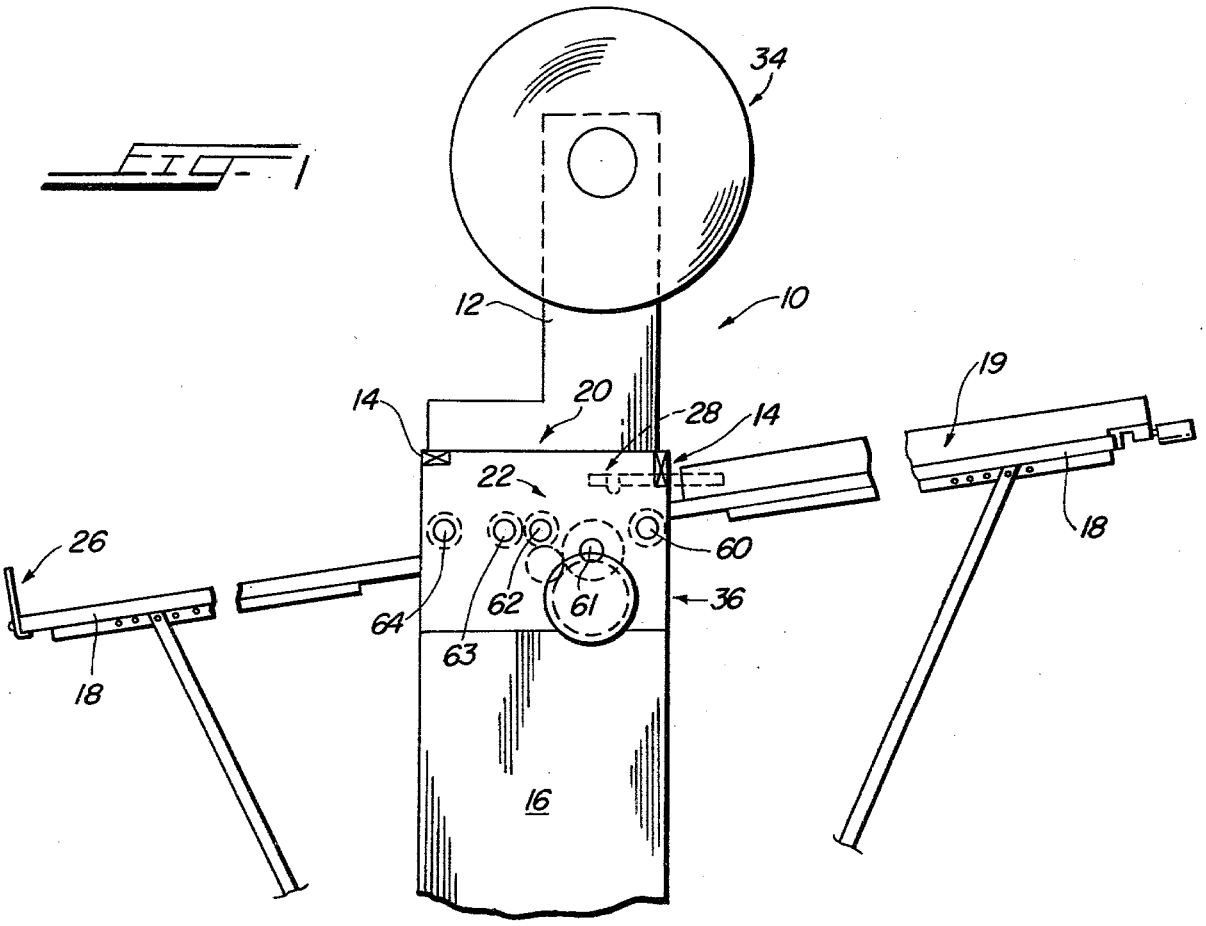
FIG. 1 is a fragmented side view of a table mounting a programmable pressure-sensitive tape applicator on the transverse bar.
Figure 2:
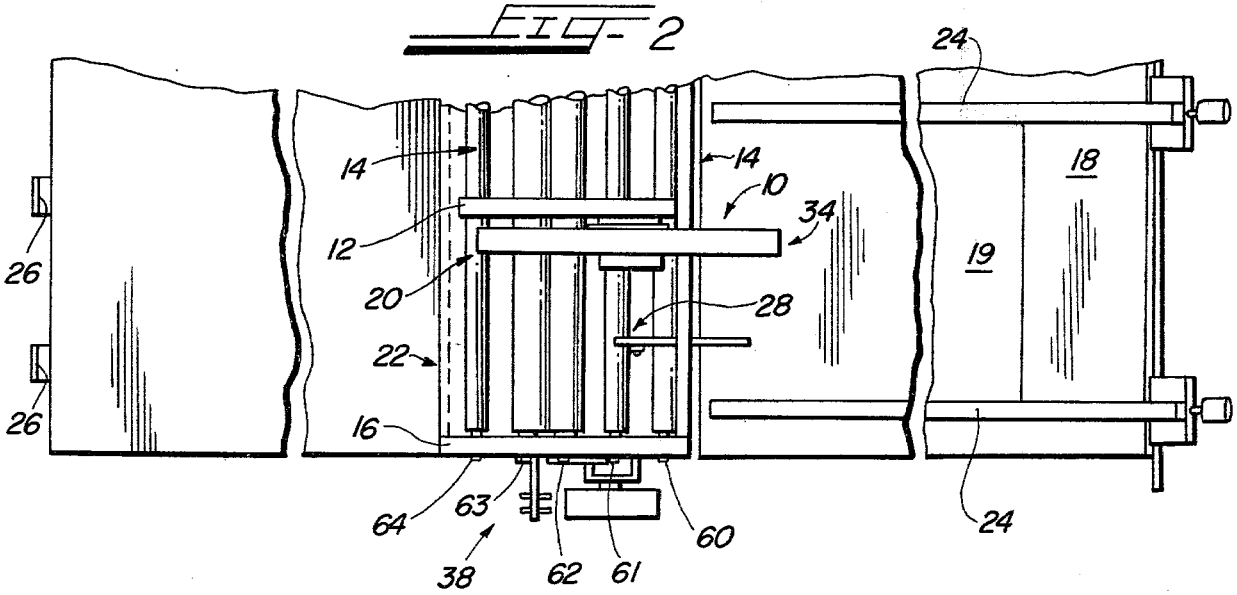
FIG. 2 is a fragmented top view of the table, tape applicator and bar of FIG. 1.
Figures 3, 4, 5:
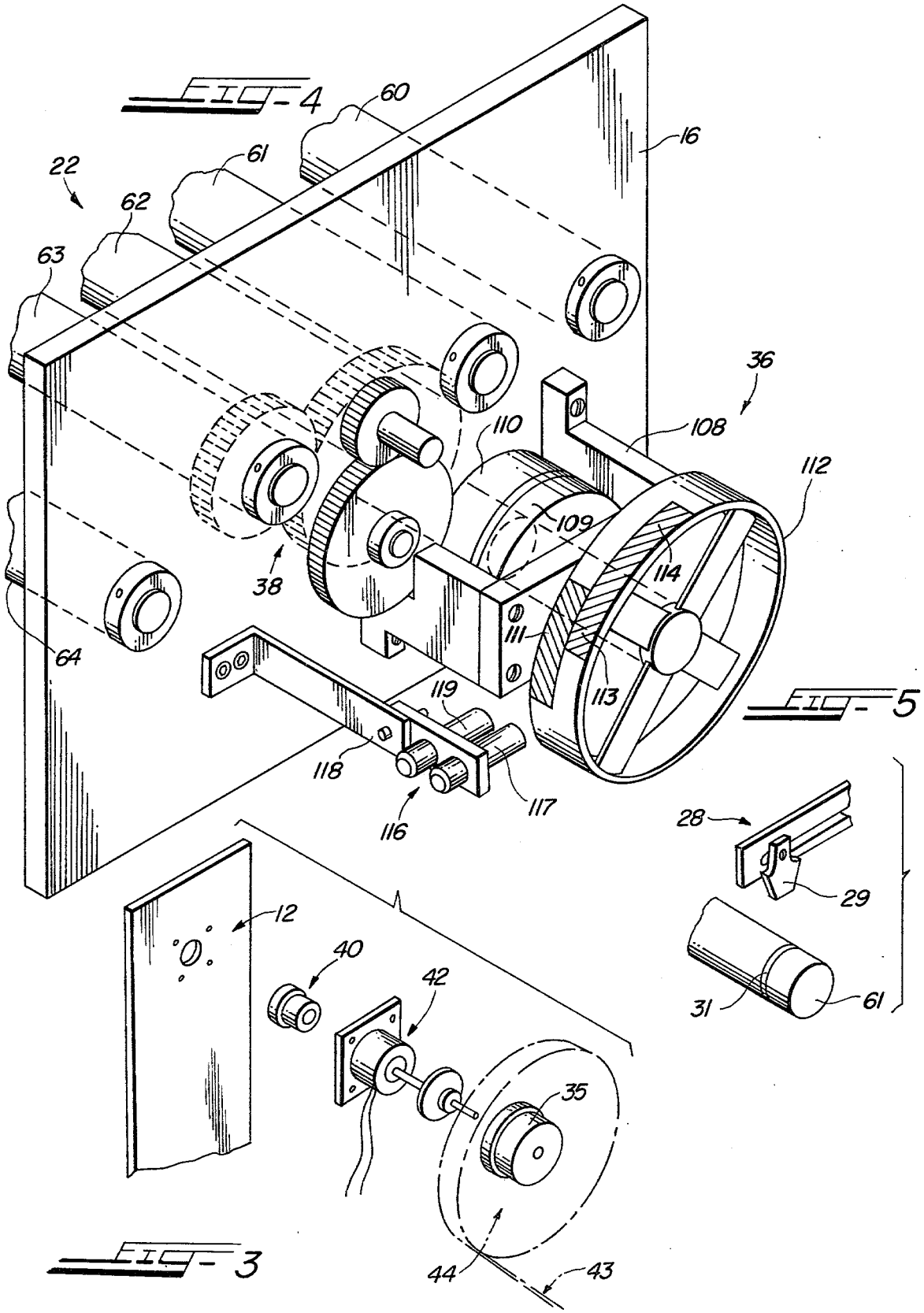
FIG. 3 is an exploded, fragmented perspective view of the tape reel of FIG. 1.
FIG. 4 is a fragmented perspective view of an opto-electronic, electro-mechanical programmer of FIG. 1.
FIG. 5 is a fragmented perspective view of the sheet sensor of FIG. 1.

Referring to FIG. 1, a tape applicator head 10 is shown having a support member 12 which typically mounts on crossbars 14 extending from side-supporting pedestals 16 for table 18 for feeding sheet material 19 according to the program. Other heads (not shown), which perforate stock, blade-slit stock, crease-score stock, and rotary-slit stock, are also adaptable. Tape application head 20 mounts on the working face of the lower portion of support member 12 above sheet feed assembly 22, comprising rubber coated roller 60, crease-score, roll-slit and perforate roller 61, application roller 62, pressure roller 63, and idler roller 64 which are rotationally-mounted in pedestals 16 on a level with the top of table 18 and driven by a drive train on the feed and control side of the same, powered by a prime mover (not shown), as shown in FIGS. 2 and 4. Sheet guide rails 24 mount on top of table 18 on its input side. A sheet-edge sensor 28, as shown in FIG. 5, mounts on a rail 14 above the sheet feed roller assembly 22 between the guide rails 24 on side support pedestals 16 and comprises an optoelectronic device having a light-emitting diode (not shown) with a modulated output and a photoelectric diode (not shown) feeding into a light-modulated input which registers the reflectivity of the presence of sheet 19 on table 18 or between side support pedestals 16 without being affected by ambient light problems when sheet 19 is not so present. A brakable reel 34 for dispensing tape 43 from a tape roll 44 rotationally mounts on the upper portion of support member 12, as shown in FIG. 3. A tape-application programmer 36 mounts on the outside face of one of pedestals 16 in operational connection with the sheet-feed roller drive train 38.

Brakable tape dispenser 34, as shown in FIG. 3, comprises a support bushing 40 and an electro-magnetic brake 42 which are jointly mounted in mutually-adjacent relation on the side of support member 12 wherein brake 42 is fixedly-mounted to the support member 12 and the shaft thereof is freely rotational in the bushing 40 attached to support member 12 until such time as said brake 42 is energized electrically. A tape reel 35 mounts a roll of pressure-sensitive tape 44 over its hub on the extended output shaft running through the brake 42 and bushing 40. Tape 43 is wound on the roll 44 with its pressure-sensitive adhesive side directed radially inward. However, the machine will handle adhesive-side out tape just as well if the tape roll 44 is reversed on reel 35.

Tape-application head 20, as shown in FIGS. 6, 7, 8 and 9, comprises a tape line slack and shock absorbent arm 48 having torsional compliance member 50 mounted about its pivotal axis at one end thereof to the working side of the lower portion of support 12 below tape dispenser 34. A plain roller 51 rotationally mounts in the line of travel of tape 43 on the other end of arm 48 which extends backwardly relative to sheet movement from its pivot axis, so as to back-loop a portion of the dispensed tape 43 with its nonadhesive-side in contact with the smooth face of roller 51. Three equal-diameter knurled guide rollers 46 rotationally-mount in the line of tape 43 travel at equal spacings on the lower portion of working side of support 12 along a vertical line which is positioned under output shaft of brake 42 and at a sidewise location relative thereto so as to forward-loop the previously back-looped portion of tape 43 coming off the roller 51 at the end of the shock control arm 48. This forward-looped portion of tape 43 travels around and down over the uppermost of and along the forward side of said knurled rollers 46 with its adhesive side always against the knurl of rollers 46. A guide track member 52 having a groove 53 in the line of tape 43 travel mounts in spaced and parallel relation alongside the forward side of the lower two knurled rollers 46 on support 12 for guiding the tape 43 in its vertical travel toward application on the moving sheet below. A plain guide roller 54 mounts on support 12 below guide track member 52 on the forward side of the line of travel of tape 43 for further guidance of tape 43. A plain pressure roller 56 rotationally-mounts on one end of an arm 58 in the line of travel of tape 43 at its point of application to moving sheet 19 above pressure roller 63 pressurizing the applied tape 43 on moving sheet 19 from above, as shown in FIG. 7. Arm 58 is pivotally-mounted at its other end on the lower portion of support 12 and has torsional-compliance member 60 mounted thereon in concentric relation about its pivotal axis.

Tape-application head 20 further comprises a shuttle assembly 66 which is mounted on the side of support 12 astraddle the vertical line of tape 43 travelling on the three equal-diameter knurled guide rollers 46. Shuttle assembly 66 has an apply-solenoid 68 which mounts on support 12 adjacent the nonadhesive side of tape 43 on a static-solenoid 70 which mounts on support 12 adjacent the adhesive side of tape 43. A shuttle bar 72 having a pin joint 74 located along its length adjacent to its static-solenoid end pins at each of both ends to each of the respective armatures of apply and static solenoids 68 and 70 and is supported on horizontal shuttle pad 76 which mounts atop guide track member 52 on support 12.

A bellcrank assembly 78, which pivotally mounts on the side of support 12 below the shuttle assembly 66 adjacent to the adhesive side of the tape 43 on guide track member 52, comprises a tape-application arm 80 which extends from a pivot 81 at one end in a forward and downward direction to terminate at its other end in the general area below and forward of the plain guide roller 54 and above the moving paper 19. A plain tape roller 82 rotationally mounts on the other end of application arm 80 in the line of travel of tape 43. Tape 43 feeds under and around roller 82 to moving sheet 19 under pressure roller 56. A tape-keeper arm 84 having a knurled roller 86 at one end rolls in contact with tape 43 on roller 82 and mounts with torsional compliance at its other end on arm 80. A driving arm 86 of bellcrank assembly 78 having one end mounted on the pivoted end of application arm 80 pin connects to the shuttle bar 72 between pin joint 74 and its pin end on the armature of adjacent static solenoid 70.

A tape-severing assembly 88, which slidingly mounts on the side of support 12 below the shuttle assembly 66 adjacent to the nonadhesive side of tape 43 on guide track member 52, comprises a base 90 which mounts on the support 12. A cutter carriage 92 slidingly mounts on the base 90 for movement generally at right angles relative to the direction of travel of tape 43 just before application to moving sheet 19. A tension spring 93, extending in the same direction as the sliding of knife 92, mounts one end to support 12 and its other end to the knife 92. A cutter blade 95 mounts on the knife 92 having its cutting edge in the same sliding direction. A pin 94 projects from the side of application arm 80 about midway between roller 82 at its one end and pivot 81 at its other. A cutter drive mechanism 98, which operationally mounts between the pin 94 on tape-application arm 80 and cutter knife 92, comprises a parallel-sided compression link 100 having a shoe 102 at one end which bears in contact with the pin 94 on arm 80 and first and second (not shown) guide rollers 104, each of which mount on the side of support 12 in straddle relation and rolling contact with a respective parallel side of link 100 for guidance generally in a compressive direction perpendicular to the radius of the center of roller 82 and clockwise about pivot 81. A 2:1 step-up or motion multiplication ratio cutter level 106, which is pin-ended at its short end to the other end of link 100, pivotally mounts on the side of support 12. The other end of lever 106 bears in contact with the knife 92 in a direction moving the cutter blade 95 toward the section of tape 43 which extends between pressure roller 56 and roller 82 at the end of application arm 80.

The tape-application programmer 36, as shown in FIG. 4, comprises a bracket 108 and an electromagnetic clutch 110 which are jointly mounted in mutually-adjacent relation on the wall of pedestal support 16 wherein the input shaft of the clutch 110 is rotationally-mounted to be driven by drive train 38 at a rate which bears a fixed relation to the rate of movement of sheet 19 on sheet feed assembly 22 and the output shaft thereof is rotationally-mounted in the bracket 108. A programming drum 112 mounts on the output shaft of clutch 110 having a torsional-spring capsule 109 unwinding in the direction opposed to rotation of drum 112 during programming which is completed within one revolution or less. Sections of optically-black indexing tape 114 are selectively applied to a reflective cylindrical surface of the drum 112 in a circumferential direction for the programming of two different layouts of tape spots.

Indexing tape sensors 116 mount on a bracket 118 on the side wall of pedestal 16 adjacent to the cylindrical surface of the drum 112, and comprise two optoelectronic sensors 117 and 119 each having a self-contained, light-emitting diode (not shown) and a photoelectric cell (not shown) which register the lack of reflectivity of optically-black tape 114 attached on the reflective cylindrical surface of drum 112.

A program of instructions for programmed application of pressure-sensitive tape 43 to the sheet 19 is stored in memory on the cylindrical surface of drum 112 as the sections of indexing tape 114. Retrieval of these stored instructions for applying the tape-applicator head 20 to moving sheet 19 according to a program is serially read from the drum 112 by rotating the drum 112 one complete rotation or less under exposure of light from optoelectronic sensors 117 and 119 for sensing the presence or absence of the indexing tape 114 thereon.

The drum drive (not shown) operationally-connects to sheet feed drive train 22 through electro-magnetic clutch 110. Clutch 110 is electrically-interconnected with the sheet-edge sensor 28 such that when sheet 19 is present on the table, clutch 110 is actuated and program drum 112 will rotate in synchronization with the movement of sheet 19 through the machine. When the sheet-edge sensor indicates that no sheet is on the table, a torsion-spring capsule 109 on the axis of the drum 112 returns the drum 112 to its initial position.

In the operation of the tape-applicator head 20 upon command of programmer 36, sheet 19 must first be sensed over roller 61 by the sheet-sensing means 28. For the operation condition of no-application of tape 43, simultaneous lock-up of the electro-magnetic brake of reel 34, as shown in FIG. 6A, while static solenoid 70 is energized for full retraction moves shuttle 66 so as to rotate arm 80 and lift roller 82 from the sheet 19. The blade 95 of the knife 92 reciprocally moves with carriage 95 to an extended position which is determined by the mechanical connection in link and lever mechanism 98 in that lever 106 fully contacts sliding carriage 92 holding it extended in readiness for starting to apply tape 43.

When the leading edge of sheet 19 passes over optoelectronic photosensor 29, clutch 110 is energized winding up torsional spring capsule 109 from rotation of drum 112 during execution of the program. De-energization of the electro-magnetic brake 42 and freeing of the reel 34, as shown in FIG. 7A, from further command of programmer 36 unlocks the tape 43 while de-energization of the static solenoid 78 and energization of the apply solenoid 68 moves shuttle 66 so as to rotate arm 80 and lower roller 82 and tape 43 toward sheet 19. The blade 95 meanwhile reciprocates to a fully-retracted position. The roller 82 on the end of application arm 80 is in fully counterclockwise position.

For ending application of tape 43, the electro-magnetic brake 42 of reel 34, as shown in FIG. 8A, is programmed to be locked while the tape-apply solenoid 68 is de-energized and the static solenoid 70 is energized toward a fully-retracted position for programming the moving of the shuttle 66 and the applicator arm 80 toward its fully-clockwise position. The roller 82 in its upward movement on the end of arm 80 then releases the tape 43 from sheet 19, and the blade 95 in its reciprocal downward motion with the knife 92 overrides the limit of mechanical connection of the elements of link and lever mechanism 98 and meets the unmoving tape 43 from sheet 19 for which static solenoid energization is programmed, as in FIG. 9A, and reel 34 is locked up so that there can be no further tape 43 dispensation. Override of blade 95 leading to separation of the mechanical connection in mechanism 98 due to inertia of carrier 92 and blade 95 carries the blade 95 against tape 43 to sever the same.

When the trailing edge of sheet 19 clears the optoelectronic photosensor 29, clutch 110 is de-energized allowing program drum 112 to return to its initial position ready to begin the next tape application cycle upon introduction of a new sheet 19.

Although but one specific embodiment of this invention is herein shown and described, it will be understood that details of the construction shown may be altered or omitted without departing from the spirit of the invention as defined by the following claims.

I claim:

1. A high speed pressure-sensitive transfer tape applicator comprising:

(a) a frame having pedestals spaced on each side of the same;

(b) a top on said frame;

(c) a sheet feed means mounted between said pedestals on the level with said top;

(d) a support member mounted between said pedestals spaced above said feed means;

(e) a tape dispenser mounted on the support member above the sheet feed means;

(f) tape applicator means mounted on the support member above the sheet feed means and below the tape dispenser operationally-connected to said tape dispenser and said sheet feed means said tape applicator means having a track for guiding the tape from the tape dispenser to the sheet feed means and a tape applicator roller adjacent to the sheet feed means mounted on an arm pivoted on the support member above and opposed to the direction of the sheet feed means relative to the tape guide track;

(g) a cutter guide track mounted on said support member above the sheet feed means and below the tape guide track directed generally along the bisecting angle between the same having a tape guide roller mounted on said support member just below said tape guide track and above the sheet feed means adjacent to the tape applicator roller;

(h) a cutter slidable in the cutter guide track having a spring operationally-connected thereto for urging a retraction from cut-off, and a step-up link and lever drive means operationally-connecting the tape applicator means with the cutter and said sheet feed means;

(i) programming means operationally-connected to said sheet feed means and to said tape applicator means; and (j) sheet sensing means operationally-connected to the programming means and with the sheet feed means to start the program when sheet is present on the sheet feed means.

2. A tape applicator, as disclosed in claim 1, wherein the programming means comprises:

(a) an electro-magnetic clutch mounted on a support pedestal having its input shaft operationally-connected to the drive train for the sheet feed means;

(b) a programming drum operationally-mounting on the output shaft of the clutch;

(c) an instructional information means stored on the cylindrical surface of the drum; and (d) information access means cooperating with the stored information means on the drum to retrieve the instructions from storage.

3. A tape applicator, as disclosed in claim 2, wherein the instructional information means comprises reflective and non-reflective sections on the cylindrical surface of the drum.

4. A tape applicator, as disclosed in claim 3, wherein the information access means comprises an optoelectronic means having a light-emitting diode optically cooperating with sections of reflective and non-reflective cylindrical surfaces on the drum to instruct the tape applicator according to program.

5. A tape applicator, as disclosed in claim 1, wherein the sheet sensing means comprises an optoelectronic means having a light-emitting diode optically cooperating with the leading and trailing edges of the sheet to register the presence of the same.

6. A tape applicator, as disclosed in claim 1, wherein the tape dispenser comprises:

(a) a brake means having a rotary output shaft mounted on the applicator head support member;

(b) a brakable reel means mounted on the output shaft of the brake means for holding a roll of pressure-sensitive transfer tape; and (c) a tape shock absorbent means mounted on the tape applicator head support member operatively-cooperating with the tape from the roll on the brakable reel means.

7. A tape applicator, as disclosed in claim 6, wherein the tape shock absorbent means comprises:

(a) a shock absorbent arm pivotally-mounted at one end on the tape applicator head support member below the tape reel;

(b) a torsionally compliant means operationally-mounting between the head support member and the shock absorbent arm about the pivot end of the same; and (c) a plain roller rotationally-mounted on the other end operationally-cooperating with the tape from the roll on the tape reel.

8. A tape applicator, as disclosed in claim 1, wherein the tape applicator means comprises:

(a) a plurality of knurled tape guide rollers rotationally-mounted on the tape applicator head support member in spaced and vertically-disposed relation below the tape shock absorbent means operationally-cooperating with the adhesive side of the tape;

(b) a tape guide track member mounted on the tape applicator head support member in spaced relation to the guide rollers operationally-cooperating with the non-adhesive side of the tape and vertically-guiding the tape moving from the reel toward the moving sheet on the feed table below;

(c) a plain guide roller for tape rotationally-mounted on the tape applicator head support member below the guide track member spaced above the moving sheet on the feed table adjacent the non-adhesive side of the tape;

(d) a tape application arm pivotally-mounted at one end on the tape applicator support member adjacent to and spaced from the guide rollers on the adhesive side of the tape and extending therefrom toward and below the plain guide roller above the sheet on the feed table below;

(e) a plain tape application roller rotationally-mounted on the end of the tape application arm operationally-cooperating with the non-adhesive side of the tape and the moving sheet on the feed table below;

(f) a keeper arm pivotally-mounted at one end with torsional compliance on the tape application arm and having a knurled tape keeper roller rotationally-mounted on the other end thereof operationally-cooperating with the adhesive side of the tape and the plane tape roller at the other end of the tape application arm on the other side of the same;

(g) a driver arm extending in a generally upward direction from one end at the pivoted end of the tape application arm;

(h) a shuttle bar slidingly-mounted on the tape application head support member astraddle the tape moving vertically from the tape reel toward the sheet below and operationally-pined to the other end of the driver arm;

(i) a double-acting pair of solenoids mounted on the tape application head support member having their armatures operationally-connected to the shuttle bar; and (j) a pressure arm pivotally-mounted at one end with torsional compliance on the tape application head support member and having a plain tape pressure roller rotationally-mounted on the other end operationally-cooperating with the non-adhesive side of the tape and the moving sheet on the feed table below.

9. A tape applicator, as disclosed in claim 1, wherein the cutter link and lever drive means comprises:

(a) a pin in the tape applicator arm;

(b) a parallel-sided compression link having guide rollers which rotationally mount on the tape applicator head support member and are adjacent each side thereof and a shoe at one end to operationally-connect and move said link along its length in a direction tangential to that of the pivotal movement of the tape applicator arm at that radial distance from the pivot; and (c) a drive lever pined at one end to the other end of the compression link and pivotally-mounted on the tape applicator head support member at a mechanical advantage in operational bearing at its other end on the one end of the cutter carriage for positive drive during cutting and operational separation therefrom for free body return under the action of the restoring compliance.

10. A sheet preparation apparatus comprising:

(a) a frame having support pedestals erected in spaced relationship on each side of the same;

(b) a sheet feed table top mounted on said frame between said pedestals;

(c) a support member mounted between said pedestals above said feed table;

(d) a pressure-sensitive transfer tape dispenser mounted on the support member having a reel mounted on the output shaft of an applicator support mounted brake, including a tape shock absorbent arm pivotally-mounted at one end on the support member below the tape reel, a torsionally compliant means operationally-mounting between the support member and the shock absorbent arm about the pivot end of the same, and a plane roller rotationally-mounted on the other end thereof operationally-cooperating with the tape from the tape reel;

(e) a tape applicator assembly mounted on the support member and operationally-connected to said tape dispenser assembly and with said sheet feed table having a plurality of knurled tape guide rollers rotationally-mounted on the tape applicator support member in spaced and vertically-disposed relation below the tape shock absorbent arm operationally-cooperating with the adhesive side of the tape, a tape guide track mounted on the tape applicator support in spaced relation to the guide rollers operationally-cooperating with the non-adhesive side of the tape and vertically-guiding the tape from the reel toward the moving sheet on the feed table below, a plane guide roller rotationally-mounted on the tape applicator support below the guide track spaced above the moving sheet on the feed table adjacent the non-adhesive side of the tape, a tape application arm pivotally-mounted at one end on the tape applicator support adjacent to and spaced from the guide rollers on the adhesive side of the tape and extending therefrom toward and below the plane guide roller above the sheet on the feed table below, a plane tape application roller rotationaly-mounted on the end of the tape application arm operationally-cooperating with the non-adhesive side of the tape and the moving sheet on the feed table below, a keeper arm pivotally-mounted at one end with torsional compliance on the tape application arm and having a knurled tape keeper roller rotationally-mounted on the other end thereof operationally-cooperating with the adhesive side of the tape and the plane tape roller at the other end of the tape application arm on the other side of the same, a driver arm extending in a generally upward direction from one end at the pivoted end of the tape application arm, a shuttle bar slidingly-mounted on the tape application support astraddle the tape moving vertically from the tape reel toward the sheet below and operationally-pinned to the other end of the driver arm, a double-acting pair of solenoids mounted on the tape application support member having their armatures operationally-connected to the shuttle bar, and a pressure arm pivotally-mounted at one end with torsional compliance on the tape application support member and having a plane tape pressure roller rotationally-mounted on the other end operationally-cooperating with the non-adhesive side of the tape and the moving sheet on the feed table below;

(f) a programming means mounted on the support member and operationally-connected to said sheet feed means and to said tape applicator assembly including an electro-magnetic clutch mounted on the support member having its input shaft operationally-connected to the drive train for the sheet feed means, and a programming drum operationally-mounting on the otput shaft of the clutch, (g) instructional information stored on the cylindrical surface of the drum having predetermined reflective and non-reflective segments on the cylindrical surface thereof, and information access means cooperating with the stored information on the drum to retrieve the instructions therefrom including the optoelectronic cooperation of light-emitting diodes with the sections of reflective and non-reflective cylindrical surfaces on the electro-magnetically clutched rotating drum;

(h) sheet sensing means mounted on the support member and operationally-connected to the programming means and with the sheet feed means to program the application of tape only when sheet is fed on the sheet feed means including light-emitting diodes optically cooperating with the leading and trailing edges of the sheet to register the pressure of the same on the sheet feed means; and (i) A tape cut-off means operationally-connected with said tape applicator assembly and with sheet feed table including a cutter guide track member mounted on the support member adjacent to and spaced from the tape guide track member against the non-adhesive side of the tape and directed therefrom toward the tape between the tape pressure roller and the tape applicator roller on the moving sheet on the feed table below, a cutter carriage slidingly-mounted in the cutter guide track having non-cutting restoring compliance operationally-connected therewith and a knife edge thereon operationally-cooperating with the tape to sever the same, and a cutter carriage link and lever actuating mechanism operationally-connecting the tape application arm with the slidable cutter carriage including a guided compression member which rotationally-mounts on the tape applicator head support member and is adjacent each side thereof and a shoe at one end to operationally-connect and move said link along its length in a direction tangential to that of the pivotal movement of the tape applicator arm at that radial distance from the pivot, and a drive lever pinned at one end to the other end of the compression link and pivotally-mounted on the tape applicator head support member at a mechanical advantage in operational bearing at its other end on the one end of the cutter carriage for positive drive during cutting and operational separation therefrom for free body return under the action of the restoring compliance.

* * * * *